US009132942B2

(12) United States Patent
Nikaein

(10) Patent No.: US 9,132,942 B2
(45) Date of Patent: Sep. 15, 2015

(54) TAMPER-EVIDENT CONTAINER

(75) Inventor: Behdokht Nikaein, Brampton (CA)

(73) Assignee: BN PROGRESSIVE PRODUCTS LTD., Brampton, Ontario, CA (US)

( * ) Notice: Subject to any disclaimer, the term of this patent is extended or adjusted under 35 U.S.C. 154(b) by 0 days.

(21) Appl. No.: 13/561,649

(22) Filed: Jul. 30, 2012

(65) Prior Publication Data

US 2013/0043247 A1 Feb. 21, 2013

Related U.S. Application Data

(60) Provisional application No. 61/526,887, filed on Aug. 24, 2011.

(30) Foreign Application Priority Data

Aug. 16, 2011 (CA) ..... 2748798

(51) Int. Cl.
*B65D 51/20* (2006.01)
*B65D 43/02* (2006.01)

(52) U.S. Cl.
CPC ..... *B65D 43/0249* (2013.01); *B65D 43/0237* (2013.01); *B65D 2101/00* (2013.01); *B65D 2101/0015* (2013.01); *B65D 2101/0023* (2013.01); *B65D 2543/00194* (2013.01); *B65D 2543/00296* (2013.01); *B65D 2543/00509* (2013.01); *B65D 2543/00555* (2013.01); *B65D 2543/00657* (2013.01); *B65D 2543/00685* (2013.01); *B65D 2543/00768* (2013.01); *B65D 2543/00796* (2013.01); *B65D 2543/00842* (2013.01)

(58) Field of Classification Search
CPC ..... B65D 2543/00657
USPC ..... 220/270, 791, 266, 23.86, 4.21, 4.23, 220/4.22, 276; 206/807
See application file for complete search history.

(56) References Cited

U.S. PATENT DOCUMENTS

| | | | | | |
|---|---|---|---|---|---|
| 2,695,645 | A | * | 11/1954 | Tupper | 220/797 |
| 3,326,408 | A | * | 6/1967 | Ringlen | 220/787 |
| 4,555,043 | A | * | 11/1985 | Bernhardt | 220/783 |
| 4,560,082 | A | * | 12/1985 | Sutch | 220/270 |
| 4,886,184 | A | * | 12/1989 | Chamourian | 220/781 |
| 5,040,695 | A | * | 8/1991 | Adams et al. | 220/270 |
| 5,092,479 | A | * | 3/1992 | Wells | 220/4.23 |
| 5,249,694 | A | * | 10/1993 | Nelson | 220/276 |
| 5,266,763 | A | * | 11/1993 | Colombo | 219/734 |

(Continued)

FOREIGN PATENT DOCUMENTS

DE 7816353 11/1978

*Primary Examiner* — Mickey Yu
*Assistant Examiner* — Gideon Weinerth
(74) *Attorney, Agent, or Firm* — Kagan Binder, PLLC.

(57) ABSTRACT

The present invention is a tamper-resistant and tamper-evident container for holding solid and liquid goods, such as food items. The container has a base portion with a male member extending upwardly from the base and extending about an opening in the base, the outer surface of the male member having a guard lip extending outwardly. The container has a cover with a female member extending upwardly for frictionally engaging the male member when the container is closed. The guard lip renders the lower edge of the outer portion of the female member relatively inaccessible. The container has a hinge connecting the cover to the base having a removable portion that may be removed to facilitate opening the container.

10 Claims, 5 Drawing Sheets

(56) References Cited

U.S. PATENT DOCUMENTS

| | | | | |
|---|---|---|---|---|
| 5,300,748 | A * | 4/1994 | Colombo | 219/734 |
| 5,507,406 | A | 4/1996 | Urciuoli et al. | |
| 5,511,680 | A * | 4/1996 | Kinne | 206/276 |
| 5,540,342 | A * | 7/1996 | Rathbun | 215/225 |
| 5,791,509 | A * | 8/1998 | Rush et al. | 220/781 |
| 5,897,011 | A * | 4/1999 | Brilliant et al. | 220/4.23 |
| 6,168,044 | B1 * | 1/2001 | Zettle et al. | 220/784 |
| 6,257,435 | B1 | 7/2001 | Chedister et al. | |
| 6,460,716 | B1 * | 10/2002 | Wong | 220/4.24 |
| 6,883,678 | B2 * | 4/2005 | Chou | 220/793 |
| 6,923,338 | B2 * | 8/2005 | Dees et al. | 220/793 |
| 7,017,776 | B1 * | 3/2006 | Hupp | 220/834 |
| 7,055,715 | B2 * | 6/2006 | Maravich et al. | 220/792 |
| 7,073,680 | B2 * | 7/2006 | Boback et al. | 220/266 |
| 7,097,066 | B2 * | 8/2006 | Tucker et al. | 220/780 |
| 7,118,003 | B2 * | 10/2006 | Sellari et al. | 220/266 |
| 7,124,910 | B2 * | 10/2006 | Nordland | 220/839 |
| 7,261,219 | B2 * | 8/2007 | Tucker et al. | 220/793 |
| 7,264,135 | B2 * | 9/2007 | Savicki et al. | 220/781 |
| 7,549,540 | B2 * | 6/2009 | Lee et al. | 206/519 |
| 7,568,589 | B2 | 8/2009 | Vovan | |
| D615,862 | S | 5/2010 | Wilson et al. | |
| 7,712,626 | B2 * | 5/2010 | Vovan | 220/791 |
| 7,874,453 | B2 | 1/2011 | Church | |
| 7,891,514 | B1 * | 2/2011 | Walsh et al. | 220/4.21 |
| D634,188 | S | 3/2011 | Sellari et al. | |
| D634,617 | S | 3/2011 | Sellari et al. | |
| D637,481 | S * | 5/2011 | Sellari et al. | D9/424 |
| D640,547 | S * | 6/2011 | Guillemin et al. | D9/428 |
| 8,083,089 | B2 * | 12/2011 | Vovan | 220/359.2 |
| 8,091,732 | B2 * | 1/2012 | Bryson et al. | 220/792 |
| 8,127,961 | B2 * | 3/2012 | Vovan | 220/270 |
| 8,317,044 | B2 * | 11/2012 | Wu et al. | 220/4.21 |
| 8,387,821 | B2 * | 3/2013 | Yin | 220/780 |
| 8,528,770 | B2 * | 9/2013 | Albrecht et al. | 220/266 |
| 8,701,919 | B2 * | 4/2014 | Messier | 220/266 |
| 2003/0155353 | A1 * | 8/2003 | Tucker | 220/4.24 |
| 2003/0183636 | A1 * | 10/2003 | Shih | 220/359.1 |
| 2003/0197021 | A1 * | 10/2003 | Chou | 220/783 |
| 2004/0118848 | A1 * | 6/2004 | Marshall | 220/266 |
| 2005/0017007 | A1 * | 1/2005 | Sellari et al. | 220/270 |
| 2005/0161455 | A1 | 7/2005 | Studee | |
| 2005/0189353 | A1 * | 9/2005 | Padovani | 220/276 |
| 2005/0230406 | A1 * | 10/2005 | Maravich et al. | 220/792 |
| 2006/0006178 | A1 * | 1/2006 | Foldesi et al. | 220/276 |
| 2006/0016821 | A1 * | 1/2006 | Liu | 220/780 |
| 2006/0278652 | A1 * | 12/2006 | Vovan et al. | 220/793 |
| 2006/0289549 | A1 * | 12/2006 | Vovan | 220/791 |
| 2007/0138180 | A1 * | 6/2007 | Vovan | 220/266 |
| 2008/0087669 | A2 | 4/2008 | Boback et al. | |
| 2009/0120937 | A1 * | 5/2009 | Vovan | 220/266 |
| 2009/0206082 | A1 * | 8/2009 | Vovan | 220/266 |
| 2010/0155289 | A1 * | 6/2010 | Nazareth et al. | 206/557 |
| 2010/0326998 | A1 * | 12/2010 | Short et al. | 220/780 |
| 2011/0036842 | A1 * | 2/2011 | Sellari et al. | 220/315 |
| 2011/0084072 | A1 * | 4/2011 | Wambeke et al. | 220/270 |
| 2012/0005994 | A1 * | 1/2012 | Tidball et al. | 53/484 |
| 2012/0048774 | A1 * | 3/2012 | Gingras et al. | 206/565 |
| 2012/0067009 | A1 * | 3/2012 | Bontrager et al. | 53/467 |
| 2013/0020325 | A1 * | 1/2013 | Stone et al. | 220/270 |
| 2013/0140311 | A1 * | 6/2013 | Roy et al. | 220/270 |
| 2013/0168394 | A1 * | 7/2013 | Messier | 220/266 |
| 2013/0320015 | A1 * | 12/2013 | Dyble et al. | 220/276 |
| 2014/0138383 | A1 * | 5/2014 | Lisowy et al. | 220/270 |
| 2014/0224803 | A1 * | 8/2014 | Pickering | 220/266 |
| 2014/0284346 | A1 * | 9/2014 | McCumber | 220/792 |
| 2014/0312046 | A1 * | 10/2014 | Yang et al. | 220/792 |
| 2015/0028033 | A1 * | 1/2015 | Samuel | 220/270 |
| 2015/0060455 | A1 * | 3/2015 | Chou | 220/270 |

* cited by examiner

TAMPER-EVIDENT CONTAINER

PRIORITY

This non provisional application claims the benefit of provisional application having Ser. No. 61/526,887, filed on Aug. 24, 2011, and entitled "TAMPER-EVIDENT CONTAINER," which application is incorporated herein by reference in its entirety. This application also claims priority from Canadian Application having serial number 2,748,798, which was filed on Aug. 16, 2011.

FIELD OF THE INVENTION

The present invention relates generally to containers, and more particularly to containers that are resistant to opening without leaving evidence that they have been opened.

BACKGROUND OF THE INVENTION

Containers are widely used in the consumer products industry to hold consumable products such as food items, for example, strawberries and cookies, and items such as screws and pins. Such items are often relatively small and sold in batches. For example, a container of strawberries may contain 25 strawberries and a container of screws may contain 200 screws. Containers containing such goods are displayed in retail stores where consumers can view and inspect them, and typically place them into a shopping, cart should a consumer choose to purchase a container of such goods.

Such containers are typically constructed from transparent plastic so that consumers can see the goods without opening the container. Allowing consumers to open a container prior to purchasing it can raise several issues. If a consumer knows that other consumers are able to open and touch or remove items, then the consumer is likely to be concerned that some items may have been removed or, in the case of food particularly, that the items have been touched in an unsanitary manner or in a manner that may otherwise make the goods less desirable or useful. Vendors are similarly concerned that such tampering with goods may dissuade consumers from purchasing containers of such items and that they may incur liability if tampering has occurred that may endanger a purchaser or make the items in the container incompatible with the terms of sale, particularly if a container may be opened and re-sealed without leaving evidence of such actions. Thus both consumers and vendors have an interest in goods being sold in containers that are resistant to such tampering, or at least are designed to leave clear evidence of such tampering after it occurs.

Thermoformed plastic containers are in wide use for consumer goods. In some cases, the container is formed so that it is permanently sealed and can only be opened by cutting or tearing the plastic. While this approach results in clear evidence of tampering, it also means that the package is not re-sealable. It is often highly desirable for such containers to be re-sealable so that a consumer can remove some items from the container and leave the remaining items in the container for future use. If the container cannot be re-sealed, then the remaining items are more likely to be accidentally lost, or be spoiled. For a food container, it is generally very desirable that the container can be re-sealed to minimize the exposure of the contents to ambient air which can result in food spoiling more quickly than it would if it were isolated from such ambient air.

SUMMARY OF THE INVENTION

The present invention provides a container having:

a. a base portion defining an interior space for holding solid or liquid goods, the interior space having an upwardly facing opening having a perimeter, the base portion having an upwardly projecting male member extending substantially about the perimeter of the opening, the male member having a top and having inner and outer surfaces extending downward from the top, each surface having a height, the outer surface of the male member having a guard lip extending outwardly below the top of the male member, the guard lip extending substantially about the perimeter of the opening;

b. a cover portion having a perimeter and a female member extending substantially about the perimeter of the cover portion, the female member having a top and having inner and outer portions extending downward from the top for frictionally engaging the inner and outer surfaces of the male member respectively to form a seal when the container is closed, each portion having a height, the outer portion of the female member having a lower edge, wherein, when the container is closed, the guard lip renders the lower edge of the outer portion of the female member relatively inaccessible; and c. a hinge connecting the outer portion of the female member to the outer surface of the male member, the hinge having a portion that is removable to facilitate opening the container.

Removing the removable portion of the hinge may expose a tab attached to the outer portion of the female member, the tab being adapted for facilitating removal of the cover portion from the base portion when the container is closed.

The outer surface of the male member may have a lower edge and the guard lip may extend outwardly from the lower edge of the outer surface of the male member.

The guard lip may have an outer edge and have a shield projecting upwardly from the outer edge, the upwardly projecting shield extending substantially about the perimeter of the opening.

The cover portion may further comprise a flange extending outwardly from the lower edge of the outer portion of the female member and extending substantially about the perimeter of the cover portion, the flange having a width, wherein the guard lip has a width greater than or equal to the width of the flange, and the height of the outer portion of the female member is greater than or equal to the height of the outer surface of the male member so that the flange abuts the guard lip when the container is closed. The guard lip may have an outer edge and have a shield projecting upwardly from the outer edge, the upwardly projecting shield extending substantially about the perimeter of the opening, wherein, when the container is closed, the upwardly projecting shield renders the flange relatively inaccessible. The flange may have an outer edge, and the flange may have sufficient width so that, when the container is closed, the outer edge of the flange abuts the upwardly projecting shield.

The hinge may connect the lower edge of the outer portion of the female member to the lower edge of the outer surface of the male member so that the hinge is substantially horizontally oriented when the container is closed.

The male and female members may extend completely about the perimeter of the opening and the perimeter of the cover portion respectively.

The outer surface of the male member and the outer portion of the female member may be substantially vertical and the guard lip may extend substantially horizontally from the outer surface of the male member. The inner surface of the male member and the outer portion of the female member may be substantially vertical.

The height of the outer portion of the female member may be greater than or equal to the height of the outer surface of the male member so that the lower edge of the outer portion of the female member abuts the guard lip when the container is closed.

The outer surface of the male member and the outer portion of the female member may have approximately equal heights so that the top of the male member abuts the top of the female member when the container is closed.

DETAILED DESCRIPTION

One embodiment of the invention is shown in FIGS. 1-3, 8 and 9 which depict a tamper-evident, or tamper-resistant, container 100 adapted for holding solid or liquid goods, such as fruit or nails. A second embodiment 1000 is shown in FIG. 10. The container 100 has a base portion 102 that defines an interior space for holding the solid or liquid goods. The base portion 102 generally has a bottom and walls extending upwardly therefrom to form the interior space. In the depicted embodiment, four walls are used in a rectangular arrangement where the four walls are connected by rounded corners. Many variations are possible. For example, the walls could have a circular or oval horizontal cross-section parallel to the bottom.

Figure 8:
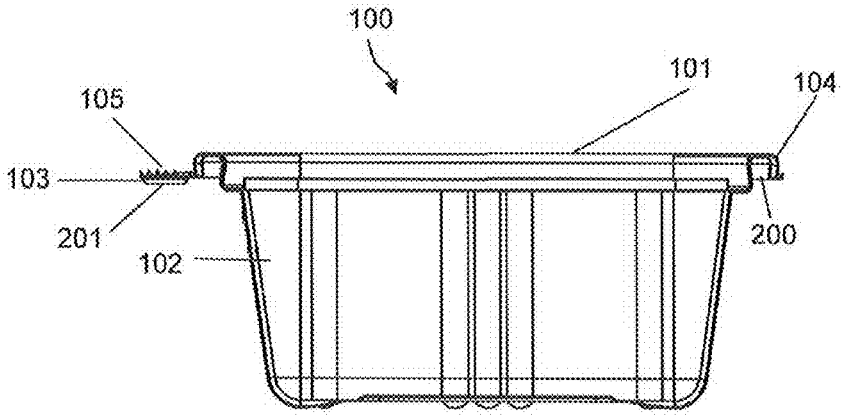
FIG. 8 is a side view of a closed container.

In this document, "horizontal", "vertical", "upward", "downward", "higher" and variations thereof are used to refer to the orientation of portions of the container 100, 1000, or cross-sections thereof, when the container is placed on a horizontal flat surface in a closed configuration with the bottom of the base portion 102 in contact with the flat surface, which is the orientation shown in FIG. 8.

Figure 2:
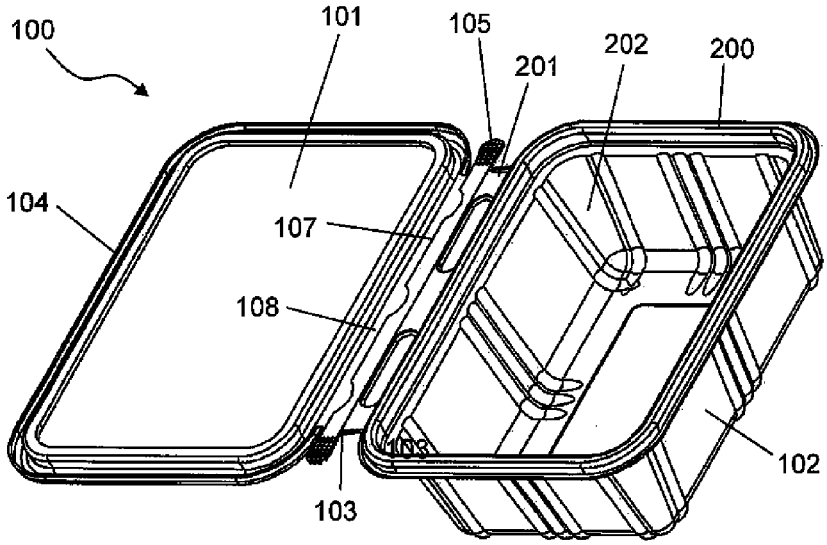
FIG. 2 is a perspective view of an open container.

The base portion 102 has an upwardly facing opening 202 that can be seen in FIG. 2. The opening allows goods to be placed into and removed from the interior space. In a typical embodiment, as depicted in FIG. 2, the opening is rectangular and extends between four walls. The walls are generally substantially vertical or outwardly sloping so that the opening 202 is approximately equal to or larger in area than the bottom of the container 100. In other embodiments, the opening may be circular or oval, particularly where the walls are in a circular or oval configuration (i.e. when horizontal cross-sections parallel to the bottom of the container 100 are circular or oval). The opening 202 is preferably parallel to the bottom of the container 100 and higher than any point within the interior space, although this is not essential.

It is not necessary that the opening 202 extend out to vertical or outwardly sloping walls as shown in the depicted embodiment. For example, a container 100 adapted for holding liquids may employ a smaller opening with an area smaller than that of the bottom of the base portion 102. In that case, the base may include a top portion extending horizontally from the side walls, the top portion defining the opening. In other embodiments, the base 102 may have no flat surfaces, but generally has a bottom portion adapted to be placed on a flat surface and maintain the container 100 in a fixed position. This may be achieved by having a flat bottom, although the upper surface of the bottom may be convex so that only the edges of the bottom contact the flat surface on which the container 100 is placed.

The base portion 102 is generally constructed so that, when the container is resting on a flat surface with its bottom portion contacting the flat surface, the opening 202 is upwardly facing and the perimeter of the opening is substantially in a horizontal plane parallel to the flat surface. This configuration is preferred particularly for containers 100 adapted to hold liquid goods.

Figure 1:
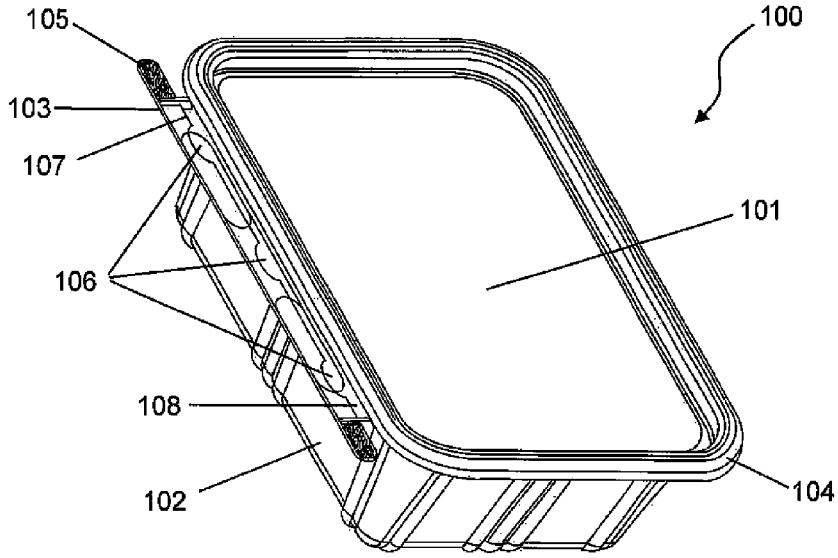
FIG. 1 is a perspective view of a closed container.

The container 100 has a cover portion 101 that is connected to the base portion 102 by a hinge. The hinge allows the cover portion 102 to be moved from an open position as shown in FIG. 2 to a closed position as shown in FIG. 1. The cover portion 101 is generally flat with a female member 104 extending substantially, and usually completely, about the perimeter of the cover portion. It is generally preferred, but is not essential, that the cover portion 101, other than the female member 104, be flat so, for example, containers 100 may be readily stacked. In some embodiments the upper surface of the cover portion 101 may be, for example, convex, which effectively increases the usable volume of the interior space for certain types of solid goods.

Figure 3:
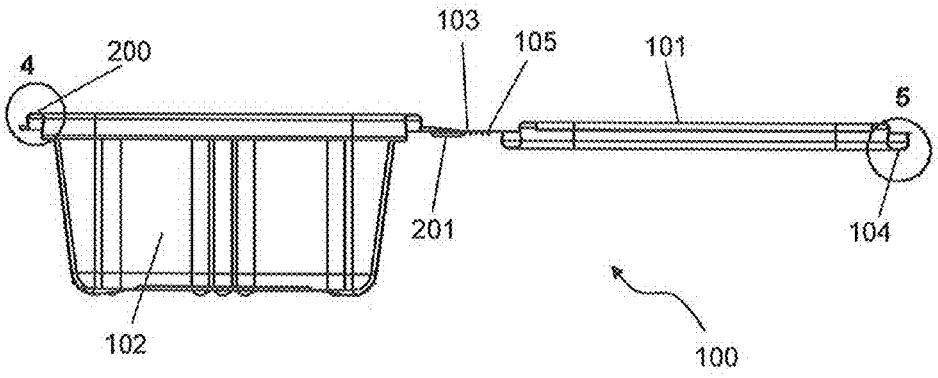
FIG. 3 is a side view of an open container.
Figure 4:
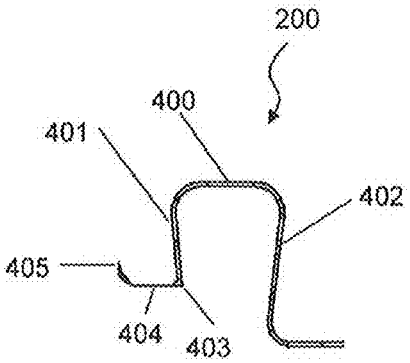
FIG. 4 is a cross-section through the circled portion marked as 4 in FIG. 3 showing a male member having an upwardly projecting shield.
Figure 5:
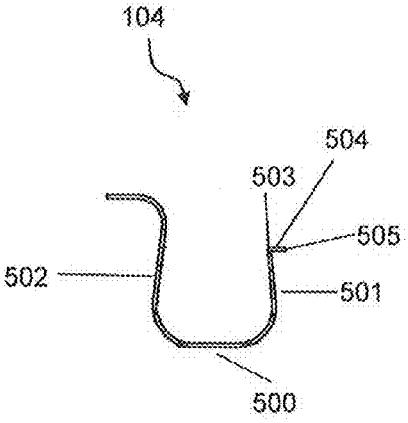
FIG. 5 is a cross-section through the circled portion marked as 5 in FIG. 3 showing an upside-down female member having a flange.

The base portion 102 has a male member 200 extending substantially, and usually completely, about the perimeter of the opening. Example embodiments of the male member 200 and female member 104 are depicted in FIGS. 3-5. The male member 200 has a top 400, and inner and outer surfaces 402, 401 extending downward from the top 400. In the embodiment depicted, there is space between the inner and outer surfaces 402, 401, but this is not essential. For example, the male member 200 may be solid, in which case the width of the male member 200, being the distance between the inner surface 402 and the outer surface 401, is generally relatively small.

The female member 104 has a top 500 and inner and outer portions 502, 501 extending downward from the top 500. The width of the female member 104, being the distance between outer surfaces of the inner portion 502 and the outer portion 501, is approximately equal to the width of the male member 200 so that the inner and outer portions, 502, 501 of the female member 104 frictionally engage the outer surfaces of the inner and outer portions 402, 401 when the container 100 is closed, as depicted in FIGS. 1 and 8. The engagement of the female member 104 with the male member 200 forms a seal that maintains the container 100 in a closed position and may reduce the intermixing of air inside the container 100 in the interior space with air outside the container 100. This is particularly useful for containers 100 adapted to hold food items.

The hinge has a lower portion 201 connected along a first tear line 103, which is straight, to a removable upper portion 105. The portions are connected so that they may rotate around the axis defined by the first tear line 103, so that the cover portion 101 may be moved from an open position to a closed position. The removable portion 105 is connected along a second tear line 107 to a flange 108 extending from the outer portion 501 of the female member 104. The tear line 107 is generally formed so that the flange 108 has one or more tabs 106 that extend outwardly after the removable portion 105 is removed for facilitating opening the container 100. For example, after the removable portion 105 is removed, a person may grasp a tab 106 between two fingers and pull it upwardly while holding the base portion 102 to remove the cover portion 101 from the base portion 102, thereby opening the container 100. In other embodiments, the tabs 106 may extend directly from the outer portion 501 of the female member 104 and the second tear line 107 be between the removable portion 105 and the outer portion 501 of the female member 104 other than in those places where the one or more tabs 106 extend.

Figure 9:
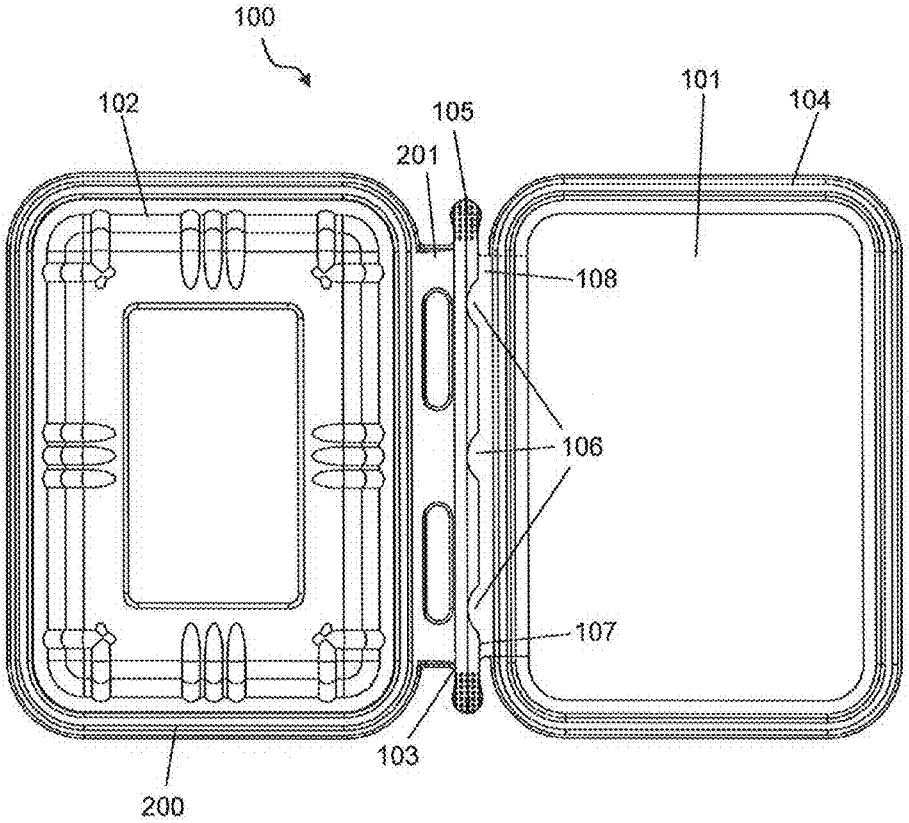
FIG. 9 is a top view of an open container.
Figure 10:
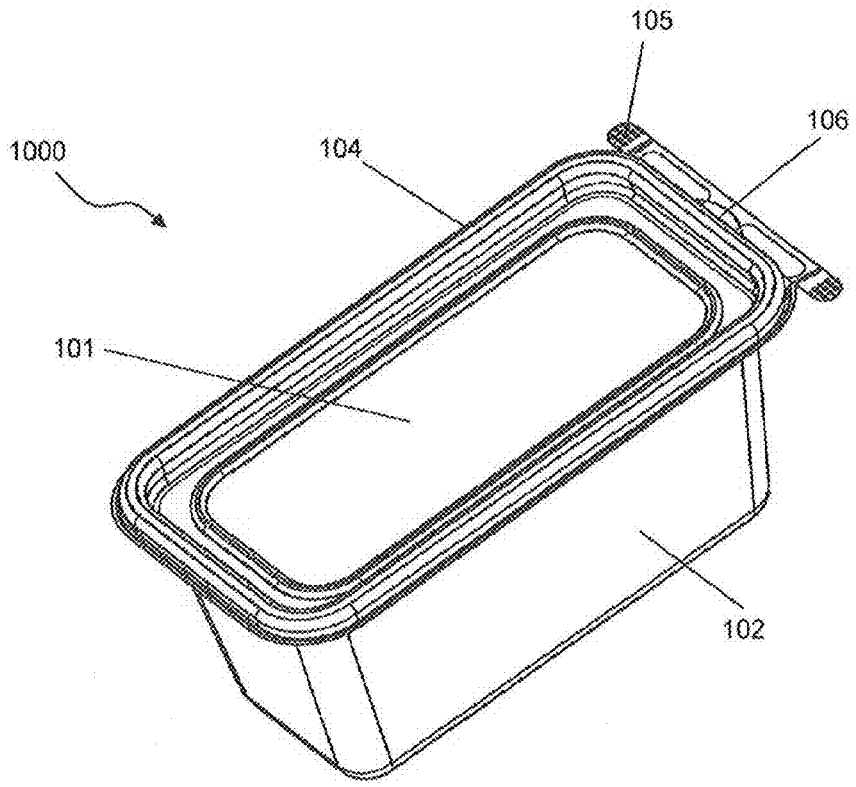
FIG. 10 is a perspective view of another embodiment of a closed container.

When a container 100 is manufactured it is generally formed in the open position as shown in FIGS. 2, 3 and 9 so that the cover portion 101 is upside-down relative to its closed position. This facilitates stacking open containers 100. Goods may then be placed into the interior space of a container 100 and the container closed by rotating the cover portion 101 about the axis defined by the first tear line 103 of the hinge until the female member 104 of the cover portion 101 meets the male member 200 of the base portion 102, the size and location of the female member 104 and male portion 200 being selected to ensure they mate to form a seal. Pressure can then be applied downward on the female member to overcome the friction between the inner and outer portions, 502, 501 of the female member 104 and the inner and outer surfaces 402, 401 of the male member 200 so that the container 100 is placed in a closed position as shown in FIG. 8.

The container 100 may then be opened by removing the removable portion 105 of the hinge, for example by grasping it between two fingers and pulling it up so as to rupture the tear lines 103, 107 and expose the one or more tabs 106 on the cover portion that facilitate removal of the cover portion from the base portion 102. The detached cover portion 101 can readily be placed back in frictional contact with the base portion 102 so that it is re-sealed by placing it on top of the opening and applying pressure downward to re-engage the male and female members 200, 104. In this manner, the container 100 may be opened and closed to re-seal it multiple times as goods stored in the interior space are consumed.

Figure 6:
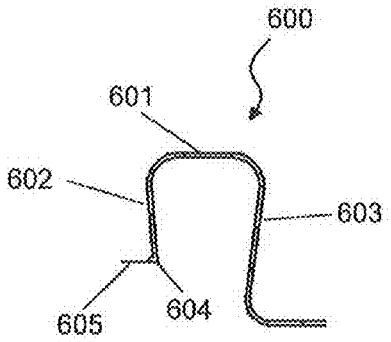
FIG. 6 is a cross section through a male member of an embodiment with no upwardly projecting shield.

The base portion 102 further includes a guard lip 404, 605 as shown in two embodiments of the male member 200, 600 in FIGS. 4 and 6. The guard lip 404, 605 extends outwardly from the outer surface 401, 602 of the male member 200, 600 below the top 400, 601 of the male member 200, 600 and extends substantially or completely about the opening 202. When the container 100 is closed, as shown in FIG. 8, the guard lip 404, 605 renders the lower edge 704, 503 of the outer portion of the female member relatively inaccessible so that it is difficult for a person to grasp the edge to open the container 100. Generally a person wanting to open the container 100 must remove the removable portion 105 of the hinge as described above, thereby leaving clear evidence, by rupturing the tear lines, that the container 100 may have been opened so that the contents may have been tampered with.

Figure 7:
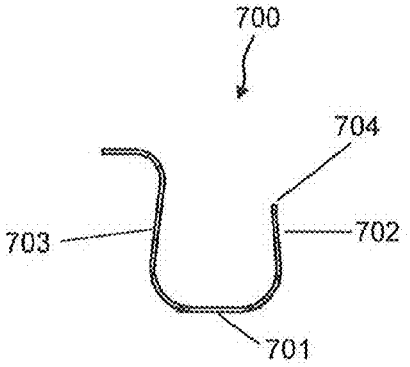
FIG. 7 is a cross section through an upside-down female member of an embodiment with no flange.

In the embodiment shown in FIG. 7, the outer portion 702 of the female member 700 may be substantially vertical and terminate at the lower edge 704. In another embodiment shown in FIG. 5, the outer portion 501 of the female member 104 may have a flange 504 extending from the lower edge 503 of the outer portion 501 of the female member 104. The inner and outer portions 502, 501 of the female member 104 are designed so that they frictionally engage the inner and outer surfaces 402, 401 of the male member 200 respectively. This may be achieved as shown in FIGS. 4-7 by making the inner and outer portions 502, 501 of the female member 104 and the inner and outer surfaces 402, 401 of the male member 200 substantially vertical and approximately the same width, and the tops 400, 500 substantially flat. When the material used to make the container 100 is flexible, it may be advantageous for the inner and outer portions 502, 501 of the female member 104 and the inner and outer surfaces 402, 401 of the male member 200 to be slightly sloped, as shown in FIGS. 4-7, so that the width of the members 200, 104 is slightly greater near the top 400, 500 than near the lower edge 403 of the outer surface 401 of the male member 200 and the lower edge 503 of the outer portion 501 of the female member 104 in order to form a better seal.

In the depicted embodiments, the tops 400, 500 of the members 200, 104 are flat and connect to the inner and outer portions 502, 501 of the female member 104 and inner and outer surfaces 402, 401 of the male member 200 via a rounded portion, but this is not essential. For example the tops 400, 500 could be rounded or the inner and outer portions 502, 501 of the female member 104 and inner and outer surfaces 402, 401 of the male member 200 may be substantially perpendicular to the tops 400, 500, connecting at a sharp edge.

The guard lip 404, 605 may extend from the lower edge 403, 604 of the outer surface 401 of the male member 200, 600 as shown in FIGS. 4 and 6, or it may extend from another point below the top 400, 601. In a preferred embodiment, the height of the outer portion 501, 702 of the female member 104, 700, the height being the vertical distance between the top 500, 701 and the lower edge 503, 704 of the female member 104, 700, is selected to be greater than or equal to the height of the outer portion 401, 602 of the male member 200, 600, the height being the vertical distance between the top 400, 601 and the lower edge 403, 604 of the male member 200, 600. In this case, the lower edge 503, 704 of the female member 104, 700 abuts the guard lip 404, 605 when the container 100 is closed. In some embodiments, the height of the outer portion 501, 702 of the female member 104, 700 is selected to be approximately equal to the height of the outer portion 401, 602 of the male member 200, 600. In this case, the lower edge 503, 704 of the female member 104, 700 abuts the guard lip 404, 605 and the top 400, 601 of the male member 200, 600, abuts the top 500, 701 of the female member 104, 700.

In some embodiments, the guard lip 404, 605 may also have a raised portion projecting upwardly from the outer edge of the guard lip 404, 605, which may be referred to as an upwardly projecting shield 405. Having an upwardly projecting shield 405 may further render the lower edge 704 of the outer portion 702 of the female member 700 relatively inaccessible when the container 100 is closed, so that it is difficult to open the container 100 without tearing off the removable portion 105 of the hinge. The upwardly projecting shield 405 may project vertically from the outer edge of the guard lip 404, 605 either via a rounded corner or by a sharp corner so that the point of contact between the upwardly projecting shield 405 and the outer edge of the guard lip 404, 605 forms a right angle. Alternatively the upwardly projecting shield 405 may be curved or sloped. The upwardly projecting shield 405 may further have a flange extending outwardly from its top edge.

In some embodiments, the female member 104 may have a flange 504 extending outwardly from its lower edge 503 of its outer portion 501. The flange 504 may extend substantially or completely about the perimeter of the cover portion 101 and preferably have a width that is less than or equal to the width of the guard lip 404, 605 so that the guard lip 404, 605 renders the flange 504 relatively inaccessible when the container 100 is closed. The flange 504 and guard lip 404, 605 may both be horizontally oriented when closed. In this case, it is preferable that the height of the outer portion 501 of the female member 104 is selected to be greater than or equal to the height of the outer portion 401, 602 of the male member 200, 600 so that the flange 504 abuts the guard lip 404, 605 when the container 100 is closed.

In some embodiments employing an upwardly projecting shield 405 on the guard lip 404, a flange 504 may be formed on the female member 104 such that the width of the flange 504 is approximately equal to the width of the guard lip 404 so that the outer edge 505 of the flange 504 abuts the upwardly projecting shield 405 when the container is closed. This may further render the flange relatively inaccessible when the container 100 is closed. In such embodiments, it is preferable that the height of the outer portion 501 of the female member 104 is selected to be greater than or equal to the height of the outer portion 401 of the male member 200 so that the flange 504 abuts the guard lip 404 when the container 100 is closed.

The tamper evident containers are thermoformed out of plug assist or cut in place thermoforming machines. In these processes, raw material first is heated to its soft point and is sent to the forming station which will be formed by means of either heat or vacuum. Then, the web of formed parts is directed to a trim station and the formed parts are separated from the web. Raw material can be any type of plastic which is formable on a thermoforming machine, such as PET, OPS, PVC, PP, LDPE, HDPE.

As will be evident to those skilled in the art, an alternative embodiment could employ a female member on the base portion and a male member on the cover portion of a container. Such an embodiment would include, by analogy to the embodiment described above:

a cover portion having an downwardly projecting male member extending substantially about the perimeter of the cover portion, the male member having a bottom and having inner and outer surfaces extending upward from the bottom, each surface having a height, the outer surface of the male member having a guard lip extending outwardly above the bottom of the male member, the guard lip extending substantially about the perimeter of the cover portion;

a base portion defining an interior space for holding solid or liquid goods, the interior space having an upwardly facing opening having a perimeter, the base portion having a downwardly projecting female member extending substantially about the perimeter of the opening, the female member having a bottom and having inner and outer portions extending upward from the bottom for frictionally engaging the inner and outer surfaces of the male member respectively to form a seal when the container is closed, each portion having a height, the outer portion of the female member having an upper edge, wherein, when the container is closed, the guard lip renders the upper edge of the outer portion of the female member relatively inaccessible; and a hinge connecting the outer portion of the female member to the outer surface of the male member, the hinge having a portion that is removable to facilitate opening the container.

In this alternative embodiment, removing the removable portion of the hinge may expose a tab attached to the outer portion of the male member, the tab being adapted for facilitating removal of the cover portion from the base portion when the container is closed.

In this alternative embodiment, the outer surface of the male member may have an upper edge and the guard lip may extend outwardly from the upper edge of the outer surface of the male member. The base portion may further include a flange extending outwardly from the upper edge of the outer portion of the female member and extending substantially about the perimeter of the opening, the flange having a width, wherein the guard lip has a width greater than or equal to the width of the flange, and the height of the outer portion of the female member is greater than or equal to the height of the outer surface of the male member so that the flange abuts the guard lip when the container is closed. The height of the outer portion of the female member may be greater than or equal to the height of the outer surface of the male member so that the upper edge of the outer portion of the female member abuts the guard lip when the container is closed. The outer surface of the male member and the outer portion of the female member may have equal heights so that the bottom of the male member abuts the bottom of the female member when the container is closed.

In this alternative embodiment, the guard lip may have an outer edge and a shield projecting downwardly from the outer edge, the downwardly projecting shield extending substantially about the perimeter of the cover In this alternative embodiment, the guard lip may have an outer edge and a shield projecting downwardly from the outer edge, the downwardly projecting shield extending substantially about the perimeter of the cover, wherein, when the container is closed, the downwardly projecting shield renders the flange relatively inaccessible. The flange may have an outer edge, and the flange may have sufficient width so that, when the container is closed, the outer edge of the flange abuts the downwardly projecting shield.

In this alternative embodiment, the outer surface of the male member may have an upper edge and the hinge may connect the upper edge of the outer portion of the female member to the upper edge of the outer surface of the male member so that the hinge is substantially horizontally oriented when the container is closed.

In this alternative embodiment, the female and male members may extend completely about the perimeter of the opening and the perimeter of the cover portion respectively.

In this alternative embodiment, the outer surface of the male member and the outer portion of the female member may be substantially vertical and the guard lip may extend substantially horizontally from the outer surface of the male member. The inner surface of the male member and the inner portion of the female member may be substantially vertical.

The scope of the claims that follow is not limited by the embodiments set forth in the description. The claims should be given the broadest purposive construction consistent with the description as a whole.

What is claimed is:

1. container comprising:

a. a base portion defining an interior space for holding solid or liquid goods, the interior space having an upwardly facing opening having a perimeter, the base portion having an upwardly projecting male member extending substantially about the perimeter of the opening, the male member having a top and having inner and outer surfaces extending downward from the top, each surface having a height, the outer surface of the male member having a guard lip extending horizontally outwardly below the top of the male member to an outer edge, the guard lip extending substantially about the perimeter of the opening, wherein the guard lip is flat and has no upwardly or downwardly members projecting from or attached to the outer edge of the guard lip;

b. a cover portion having a perimeter and a female member extending substantially about the perimeter of the cover portion, the female member having a top and having inner and outer portions extending downward from the top for frictionally engaging the inner and outer surfaces of the male member respectively to form a seal when the container is closed, each portion having a height, the outer portion of the female member having a lower edge, wherein, when the container is closed, the guard lip renders the lower edge of the outer portion of the female member relatively inaccessible; and c. a hinge connecting the outer portion of the female member to the outer surface of the male member, the hinge having a portion that is removable to facilitate opening the container, wherein the outer surface of the male member and the outer portion of the female member are substantially vertical and the guard lip extends substantially horizontally from the outer surface of the male member, and wherein no portion of the cover portion extends outward beyond the substantially vertical outer portion of the female member, and wherein the outer surface of the male member has a lower edge and the guard lip extends outwardly from the lower edge of the outer surface of the male member, and wherein the height of the outer portion of the female member is approximately equal to the height of the outer surface of the male member so that the lower edge of the outer portion of the female member abuts the guard lip when the container is closed and the top of the male member abuts the top of the female member when the container is closed, and wherein the outer portion of the female member contains no apertures or holes therethrough.

2. The container of claim 1 wherein removing the removable portion of the hinge exposes a tab attached to the outer portion of the female member, the tab being adapted for facilitating removal of the cover portion from the base portion when the container is closed.

3. The container of claim 1 wherein the outer surface of the male member has a lower edge and wherein the hinge connects the lower edge of the outer portion of the female member to the lower edge of the outer surface of the male member so that the hinge is substantially horizontally oriented when the container is closed.

4. The container of claim 1 wherein the male and female members extend completely about the perimeter of the opening and the perimeter of the cover portion respectively.

5. The container of claim 1 wherein the inner surface of the male member and the inner portion of the female member are substantially vertical.

6. A container comprising:

a. a cover portion having an downwardly projecting male member extending substantially about the perimeter of the cover portion, the male member having a bottom and having inner and outer surfaces extending upward from the bottom, each surface having a height, the outer surface of the male member having a guard lip extending horizontally outwardly above the bottom of the male member to an outer edge, the guard lip extending substantially about the perimeter of the cover portion, wherein the guard lip is flat and has no upwardly or downwardly members projecting from or attached to the outer edge of the guard lip;

b. a base portion defining an interior space for holding solid or liquid goods, the interior space having an upwardly facing opening having a perimeter, the base portion having a downwardly projecting female member extending substantially about the perimeter of the opening, the female member having a bottom and having inner and outer portions extending upward from the bottom for frictionally engaging the inner and outer surfaces of the male member respectively to form a seal when the container is closed, each portion having a height, the outer portion of the female member having an upper edge, wherein, when the container is closed, the guard lip renders the upper edge of the outer portion of the female member relatively inaccessible; and c. a hinge connecting the outer portion of the female member to the outer surface of the male member, the hinge having a portion that is removable to facilitate opening the container, wherein the outer surface of the male member and the outer portion of the female member are substantially vertical and the guard lip extends substantially horizontally from the outer surface of the male member, and wherein no portion of the base portion extends outward beyond the substantially vertical outer portion of the female member, and wherein no portion of the base portion extends outward beyond the horizontal guard lip on the male member, and wherein the outer surface of the male member has an upper edge and the guard lip extends outwardly from the upper edge of the outer surface of the male member, and wherein the height of the outer portion of the female member is approximately equal to the height of the outer surface of the male member so that the upper edge of the outer portion of the female member abuts the guard lip when the container is closed and the bottom of the male member abuts the bottom of the female member when the container is closed, and wherein the outer portion of the female member contains no apertures or holes therethrough.

7. The container of claim 6 wherein removing the removable portion of the hinge exposes a tab attached to the outer portion of the male member, the tab being adapted for facilitating removal of the cover portion from the base portion when the container is closed.

8. The container of claim 6 wherein the outer surface of the male member has an upper edge and wherein the hinge connects the upper edge of the outer portion of the female member to the upper edge of the outer surface of the male member so that the hinge is substantially horizontally oriented when the container is closed.

9. The container of claim 6 wherein the female and male members extend completely about the perimeter of the opening and the perimeter of the cover portion respectively.

10. The container of claim 6 wherein the inner surface of the male member and the inner portion of the female member are substantially vertical.

* * * * *